US009058966B2

(12) United States Patent
Otsuka

(10) Patent No.: US 9,058,966 B2
(45) Date of Patent: Jun. 16, 2015

(54) IONIZATION DEVICE, MASS SPECTROMETER INCLUDING IONIZATION DEVICE, IMAGE DISPLAY SYSTEM INCLUDING MASS SPECTROMETER, AND ANALYSIS METHOD

(71) Applicant: CANON KABUSHIKI KAISHA, Tokyo (JP)

(72) Inventor: Yoichi Otsuka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 14/018,119

(22) Filed: Sep. 4, 2013

(65) Prior Publication Data

US 2014/0070094 A1 Mar. 13, 2014

(30) Foreign Application Priority Data

Sep. 7, 2012 (JP) ..... 2012-197205

(51) Int. Cl.
*H01J 49/16* (2006.01)
*H01J 49/26* (2006.01)
*H01J 49/00* (2006.01)

(52) U.S. Cl.
CPC ..... *H01J 49/16* (2013.01); *H01J 49/26* (2013.01); *H01J 49/0004* (2013.01)

(58) Field of Classification Search
CPC ..... H01J 49/16; H01J 49/0027; H01J 49/168
USPC ..... 250/258, 288, 423 P
See application file for complete search history.

(56) References Cited

U.S. PATENT DOCUMENTS

| | | | | |
|---|---|---|---|---|
| 8,097,845 | B2 | 1/2012 | Roach et al. | |
| 2006/0113463 | A1 * | 6/2006 | Rossier et al. | 250/288 |
| 2009/0272892 | A1 * | 11/2009 | Vertes et al. | 250/282 |

FOREIGN PATENT DOCUMENTS

JP 4366508 B2 11/2009

* cited by examiner

*Primary Examiner* — Robert Kim
*Assistant Examiner* — Kevin Chung
(74) *Attorney, Agent, or Firm* — Canon USA Inc. IP Division

(57) ABSTRACT

An ionization device includes: a holding portion configured to hold a sample; a probe configured to arrange a liquid on a surface of the sample to form a liquid bridge between the probe and the sample; an electrode configured to form, at the probe, a Taylor cone for ionizing a substance contained in the sample, and to release the ionized substance from the Taylor cone; a voltage applying unit configured to apply a voltage to the electrode; and a light source configured to emit laser light that irradiates the Taylor cone. A mass spectrometer including the ionization device, and an image display system including the mass spectrometer are also disclosed.

15 Claims, 6 Drawing Sheets

IONIZATION DEVICE, MASS SPECTROMETER INCLUDING IONIZATION DEVICE, IMAGE DISPLAY SYSTEM INCLUDING MASS SPECTROMETER, AND ANALYSIS METHOD

BACKGROUND OF THE INVENTION

1. Field of the Invention

The present invention relates to an ionization device, a mass spectrometer including the ionization device, an image display system including the mass spectrometer, and an analysis method.

2. Description of the Related Art

There are technologies to ionize solid materials in an atmospheric pressure environment for a component analysis of a sample.

Also, an imaging mass spectrometry (IMS) has been developed, which displays an image indicating what kind of substance exists on which part of the surface.

U.S. Pat. No. 8,097,845 discloses a method of providing a solvent to a fine region of a solid surface in an atmospheric pressure environment to ionize a substance (solute) dissolved in the solvent.

The specification of U.S. Pat. No. 8,097,845 discloses use of a supply capillary and a collection capillary. The two capillaries are positioned such that mutual end portions are situated at very close positions. One capillary (supply capillary) supplies a solvent, and the other capillary (collection capillary) moves a solvent (solution) containing a solute from the solid into an ionization portion. A high voltage is applied to the solvent, and the solute is ionized in the ionization portion at the end portion of the above-described other capillary.

Further, a method of irradiating a liquid sample mixed with an analyte with laser light to improve ionization efficiency of the analyte has been proposed in Japanese Patent No. 4366508.

In the method of Japanese Patent No. 4366508, it is known that the ionization can be facilitated by using local heating due to absorption of infrared laser light by water molecules in the solvent.

However, in the method disclosed in U.S. Pat. No. 8,097,845, locations of a process of dissolving a sample in a solvent (sampling process) and of a process of occurrence of ionization (ionization process) are separated, and a time lag exits between the processes. Therefore, it is difficult to perform the analysis at high speed.

In addition, the sampling process occurs in a space and the ionization process occurs in a different space. After the sampling process, the solvent are continuously transported to the ionization process through the passage. As the sample surface is scanned with the capillary in order to image the distribution of components on the solid surface, the solvent, in which the sample is dissolved, may be mixed while passing through the passage, and it may be difficult to correspond the position of the sampling process and the obtained result of the ionization.

In addition, in the method disclosed in Japanese Patent No. 4366508, it is necessary that the sample is dissolved in the solvent in advance, and it is difficult to dissolve the fine region of the sample and to promptly perform the ionization.

SUMMARY OF THE INVENTION

To address the above-noted and other shortcomings of the known technology, the present invention provides a novel ionization device. In accordance with at least one embodiment of the present invention, an ionization device includes: a holding portion configured to hold a sample; a probe configured to arrange a liquid on a surface of the sample to form a liquid bridge between the probe and the sample; an electrode configured to form, at the probe, a Taylor cone including a substance contained in the sample, and to release the ionized substance from the Taylor cone; a voltage applying unit configured to apply a voltage to the electrode; and a light source configured to emit laser light, wherein the light source is arranged such that the laser light irradiates the Taylor cone.

Further, another present invention is an analysis method including: applying a voltage to a liquid; arranging the liquid on a surface of a sample to form a liquid bridge between a probe and the sample; applying a voltage to an electrode to form, at the probe, a Taylor cone including a substance contained in the sample; irradiating the Taylor cone with laser light; and analyzing the mass of the substance released from the Taylor cone and ionized.

Further features of the present invention will become apparent from the following description of exemplary embodiments (with reference to the attached drawings).

DESCRIPTION OF THE EMBODIMENTS

First Embodiment

An ionization device according to a first embodiment of the present invention includes: a holding portion configured to hold a sample; a probe configured to arrange a liquid on a surface of the sample to form a liquid bridge between the probe and the sample; an electrode configured to form, at the probe, a Taylor cone including a substance contained in the sample, and to release the ionized substance from the Taylor cone; a voltage applying unit configured to apply a voltage to the electrode; and a light source configured to emit laser light, wherein the light source is arranged such that the laser light irradiates the Taylor cone.

Figure 1:
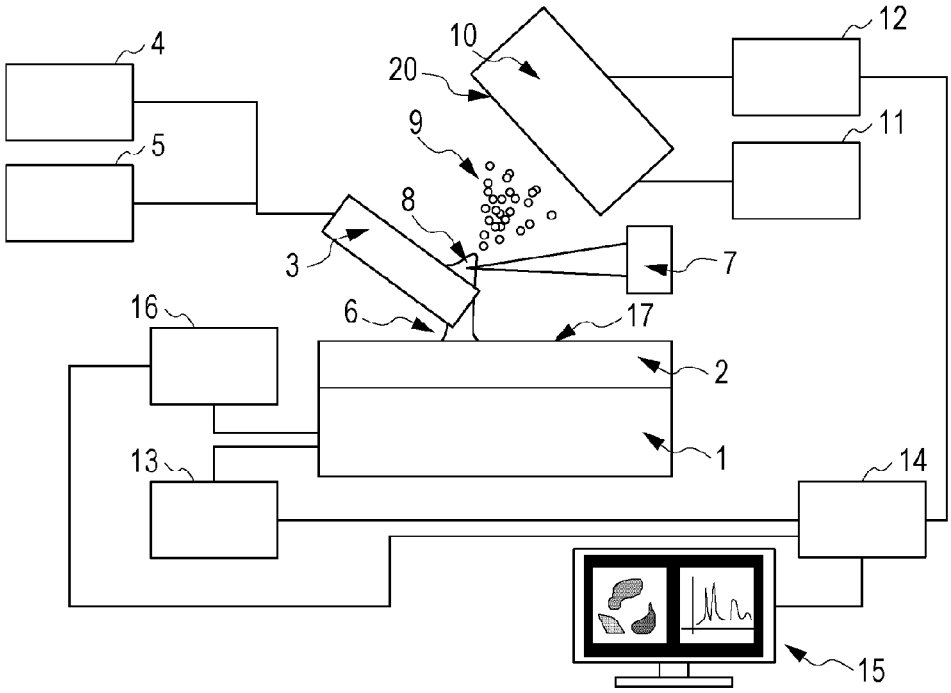
FIG. 1 is a schematic diagram illustrating an image display system including an ionization device according to a first embodiment.

FIG. 1 is a schematic diagram illustrating an image display system including an ionization device according to a first embodiment of the present invention.

A sample 2 is held by a holding portion 1. The sample 2 is a section (cell group) of biological tissue. A probe 3 has a needle shape, and an end portion thereof is in contact with the sample 2, or is arranged at an extremely close position to the sample 2, as illustrated in FIG. 1. The probe 3 has a passage (not illustrated) in its inside, and supplies a solvent to a surface 17 of the sample 2 through the passage. The solvent is a liquid capable of dissolving a substance contained by the sample as a solute. The solvent in which the solute is dissolved is hereinafter called "solution". The solvent is favorably a mixture of water and organic solvent, and is more favorably a mixture of the mixture and at least one of an acid and a base. However, only the water or organic solvent is applicable. The mixture that is a solvent comes in contact with the sample 2, so that a substance easily dissolved in the solvent contained in the sample (at least one of fats, sugar, and a molecule having an average molecular weight of 20 to one hundred million (exclusive of one hundred million)) can be easily dissolved, and the liquid that is a solvent is changed into a solution.

Here, dissolution refers to a state in which molecules, atoms, and fine particles are dispersed in a solvent.

Examples of the easily dissolved substance include lipid molecule that constitutes a cell membrane, sugar included in the cell or protein floating in the cell, and peptide, and examples of the less-easily dissolved substance include protein forming cytoskeleton and protein anchored by the cytoskeleton.

The solvent is continuously supplied from a liquid supply unit 4 to the probe 3. At that time, a voltage is applied to the solvent by voltage applying unit 5. The solvent supplied from the probe 3 forms a liquid bridge 6 between the end portion of the probe 3 and the sample 2. The liquid bridge 6 is a liquid in a state where it bridges the probe 3 and the sample 2. This uses surface tension, and the like. A substance contained in the sample 2 is dissolved in the liquid bridge 6. The liquid bridge 6 is formed in an atmospheric pressure environment. The volume of the liquid bridge 6 is extremely small quantity and is about $1\times10^{-12}$ $m^3$. The liquid bridge 6 is arranged in a partial region on the surface 17 of the sample 2, and the area of the liquid bridge 6 on the surface 17 of the sample 2 is about $1\times10^{-8}$ $m^2$.

Note that the liquid bridge 6 is arranged in an extremely narrow region on the surface 17 of the sample 2. Therefore, the ionization device according to the present embodiment includes a displacing unit 13 that causes the sample 2 to scan the surface 17 in an in-plane direction so that a broader range of the surface 17 of the sample can be analyzed. To be specific, a holding portion 1 is displaced by the displacing unit 13.

The holding portion 1 includes a vibration imparting unit 16. The holding portion 1 vibrates by the vibration imparting unit 16, and the liquid bridge 6 vibrates. The vibration of the liquid bridge 6 is transferred to a Taylor cone 8 described below. The vibration direction of the holding portion 1 by the vibration imparting unit 16 is a vertically up and down direction. A substance less-easily dissolved in the solvent can be more easily dissolved by using a combination of the irradiation of the laser light and the vibration.

The ionization device according to the present embodiment includes an electrode 10 (also referred to as ion extraction electrode) and a voltage applying unit 11 used to apply a voltage to the electrode 10. When the voltage applying unit 11 applies a voltage to the electrode 10 to cause a potential difference between the solution and the electrode 10, the solution transferred to the surface of the probe 3 from the liquid bridge 6 forms a cone shaped Taylor cone extending from the end portion of the probe 3 towards the electrode 20. The Taylor cone shape is caused by the potential difference (favorably, 1 kV to 10 kV, more favorably, 3 kV to 5 kV) between the solution attached to the end portion of the probe 3 and the surface (electrode surface 20) of the electrode 10. As used herein, a Taylor cone refers to the cone observed in electrospinning, electrospraying and more generally in hydrodynamic spray processes from which a jet of charged particles emanates in response to a potential difference above a threshold voltage. Specifically, when a small volume of electrically conductive liquid is exposed to an electric field, the shape of liquid starts to deform from the shape caused by surface tension alone. As the voltage is increased the effect of the electric field becomes more prominent and, as the electric field approaches exerting a similar amount of force on the droplet as the surface tension does, a cone shape begins to form with convex sides and a rounded tip. When a certain threshold voltage has been reached the slightly rounded tip inverts and emits a jet of liquid. This is called a cone-jet and is the beginning of the electrospraying process in which ions may be transferred from a liquid substance to the gas phase. It has been generally found that in order to achieve a stable cone-jet a slightly higher than the threshold voltage should be used.

In the present embodiment, when the voltage continues to be applied to the electrode 10 by the voltage applying unit 11, a charged solution is tore off from the Taylor cone 8 to become charged droplets 9, and these droplets are sprayed to the electrode 10.

A light source 7 that emits laser light is arranged to irradiate the Taylor cone with the laser light. The light source 7 is arranged in close proximity to the sample 2 on an opposite side of the holding portion 1. Note that a general concept of "the laser light irradiates the Taylor cone" includes a case in which the laser light irradiates the entire Taylor cone and a case in which the laser light irradiates a part of the Taylor cone.

A camera (not shown) for observing an irradiation spot may be housed within the light source 7 or nearby thereto. Observing an irradiation spot served to confirm a light irradiated position from the overlaid image both of Taylor cone and focused light spot. Accordingly, the light at the light irradiated position is observed by the camera, and the position of the light source 7 or the probe 3 is adjusted to allow the Taylor cone 8 and the light irradiated position of the laser light to overlap with each other, so that the laser light can efficiently irradiate the Taylor cone 8. When the Taylor cone 8 is observed, it is desirable to stop emission of the laser light, or to use an optical filter that does not transmit a wavelength range of the laser light. When the light irradiated position is observed, it is desirable to use an optical filter that transmits the wavelength range of the laser light. It is desirable to use a positioning device such as a stepping motor for adjustment of the light source 7 or the probe 3, and the positioning device can be connected to a supporting portion of the light source 7 or the probe 3.

A spot size of the laser light inside the Taylor cone 8 has an area of about $1\times10^{-12}$ $m^2$ or more. The spot size can be arbitrarily changed with a laser light collection lens (not illustrated), and can be larger than the Taylor cone 8.

The laser light is pulsed light having a pulse width of about few femto seconds ($10^{-15}$ sec) to several nanoseconds ($10^{-9}$ sec), and the laser light having the power of 10 $J/m^2$ or more is used. The wavelength of the laser light may be any in the ultraviolet region, the visible region, or the infrared region. A drive unit is housed in the light source 7 so that the pulsed laser light can be emitted therefrom. The light source 7 and drive unit therefor may be located away from the sample 2 and the probe 3, and the laser light may be delivered to the vicinity of the Taylor cone by an optical fiber or other optics.

A substance having been dissolved from the sample 2 and contained in the droplets 9 is sprayed and ionized by the voltage applied to the electrode 10. Note that the series of processes including the formation of the Taylor cone, the spray of the charged droplets 9, and the ionization of the substance contained in the charged droplets 9 are hereinafter collectively called electrospray ionization, which is a well known technique used in mass spectrometry for producing ions. Herein, a general concept of "releasing the ionized substance from the Taylor cone" includes a concept of releasing charged droplets containing a non-ionized substance from the Taylor cone, and ionizing the substance in a state where the charged droplets are being sprayed (scattered).

The solvent of liquid bridge 6 are transported to the Taylor cone 8 continuously due to the electric field. During the electrospray ionization, the substance is supplied from the surface 17 of the sample 2 to the liquid bridge 6. A charged solution is continuously supplied to the probe 3, and spray is continuously caused. The formation of the liquid bridge 6 and the ionization of the substance are performed by the same probe 3.

When the laser light irradiates the Taylor cone 8, as in the present embodiment, the substance can be easily ionized. By the laser light irradiating the Taylor cone 8, a condensed substance that is a part of the solute in the solution made of the solvent and the solute is decomposed into fine particles. As a result, the contact area between the substance and the solvent is increased, and a lot of charges are given to the substance from the charged solvent. In addition, when the wavelength of the laser light overlaps with the optical absorption wavelength range of the solvent, the solvent is heated by the irradiation of the laser light, and the substance is more easily ionized.

The electrode 10 is connected with the voltage applying unit 11, and a voltage is applied by the voltage applying unit 11. The electrode 10 has a cylindrical shape and is a structure including a passage (not illustrated). When voltage is applied to the electrode, the electrode surface 20 draws in ions contained in the droplets 9 separated from the Taylor cone 8. A pump (not illustrated) is provided in the electrode surface 20, and the ions are drawn in to the electrode 10 along with the external environment, that is, with the atmosphere. The ions are drawn in to the electrode 10 either in a droplet state or in a gas phase state.

The mass spectrometer according to the present embodiment includes the above-described ionization device according to the present embodiment as the ionization unit, a mass spectrometry unit 12, and an analysis position specifying unit 14. The ions drawn in to the electrode 10 reach the mass spectrometry unit 12. In the mass spectrometry unit 12, the ions fly in a gas phase state. The mass spectrometry unit 12 is a time-of-flight mass spectrometry unit using a time of flight (TOF) measurement method. The ions fly in a vacuum flight space included in the mass spectrometry unit 12, so that the mass spectrometry unit 12 measures a mass-to-charge ratio of the ions, and analyzes the mass of the ionized substance.

The analysis position specifying unit 14 specifies a portion to be ionized on the surface 17 of the sample 2. In other words, the mass spectrometer specifies a portion of the sample to be analyzed. In response thereto, the displacing unit 13 displaces the holding portion 1 such that the substance existing on the portion to be analyzed can be included in the Taylor cone 8 through the liquid bridge 6. The analysis position specifying unit 14 is, for example, a programmed computer. The analysis position specifying unit 14 is connected to the vibration imparting unit 16 and to other devices related thereto.

The analysis position specifying unit 14 included in the mass spectrometer according to the present embodiment not only specifies the portion to be ionized on the surface 17 of the sample 2, but also processes image information. Specifically, analysis position specifying unit 14 (computer) processes information used for displaying an image of a distribution of the substance contained in the sample 2 from information of an analysis position (a portion to be analyzed in the sample 2) of the sample 2 and information of the mass (the mass spectrum) obtained from the above-described mass spectrometer.

An image display system according to the present embodiment includes the above-described mass spectrometer according to the present embodiment and an image display unit 15, as shown in FIG. 1.

The image information output from an output unit (not illustrated) of the analysis position specifying unit 14 is input to the image display unit 15 such as a flat panel display connected with the analysis position specifying unit 14, and an image is displayed. The image information may be a two-dimensional image or a three-dimensional image.

In this manner, an analysis of the substance having been dissolved from a specific position of the sample 2 and contained in the liquid bridge 6 can be obtained based on a result of the mass spectrometry of the specific position of the sample 2. Data of the mass spectrum obtained by changing the specific position within the surface 17 of the sample 2 and performing the mass spectrometry at each position, and the information of the specific positions are combined, so that the distribution of the substance of the sample 2 (in many cases, the distribution of the substance on the surface 17 of the sample 2) is mapped, and is displayed as an image (superimposed and displayed). Not only the position but the amount of the substance are displayed, and the difference in amount is displayed in color or brightness. If there is a plurality of analyzed substances in the sample 2, the images can be made such that the substances are displayed in different colors, and the difference in amount between the substances can be displayed in corresponding levels of brightness. Alternatively, a microscopic image of the sample 2 obtained in advance and an obtained image related to the mass of the sample 2 can be superimposed and displayed.

While, in the ionization device according to the present embodiment, a biological tissue section is used as the sample 2, a liquid mixture including an acid or a base, water, and an organic solvent is used as the solvent, at least any of fats, sugar, and molecules having the average molecular weight of 20 to one hundred million (exclusive of one hundred million) is given as an example of the easily dissolved substance of the solute, and a polymer molecule having the average molecular weight of 20 to one hundred million (exclusive of one hundred million) is given as an example of the less-easily dissolved substance of the solute, the ionization device according to the present invention is applicable to other combinations of the sample, solvent, and solute. For example, an example of using other solvents includes a case in which the proportion of an acid or a base, water, and an organic solvent is changed. Note that the proportion may be a case in which any of the components is 0, that is, any of the components is not included. By changing the proportion, the solubility to a liquid mixture of the water-soluble molecule and the fat-soluble molecule contained in the sample is changed, and ionization of desired molecules can be prioritized.

Since the ionization device of the present embodiment has a configuration in which the voltage applying unit 5 applies a voltage to the solvent via the probe 3, it is favorable that the probe 3 is formed of an insulator, and the solvent having made in contact with an electrode (not illustrated) existing outside the probe 3 is charged and poured into the probe 3. Note that the ionization device according to the present invention may have a form in which the voltage applying unit 5 applies a voltage to the probe 3, and as a result, the voltage is applied to the solvent. In such an embodiment, it is favorable to configure such that the probe 3 is formed of a conductive material, and the solvent comes in contact with the conductive material.

While the ionization device according to the present embodiment has a configuration in which the voltage applying unit 5 and the voltage applying unit 11 separately exist, the ionization device according to the present invention may have a configuration that includes either the voltage applying unit 5 or the voltage applying unit 11. In such a case, one unit also functions as the other unit.

While the ionization device according to the present embodiment has a configuration in which the probe 3 includes a passage in its inside, and a solvent flows in the passage, the ionization device according to the present invention may have a configuration in which droplets are supplied from the liquid supply unit 4 to the probe 3, and go along the surface of the probe 3 to form the liquid bridge 6 at the end portion of the probe 3. Alternatively, the ionization device may have a configuration in which the probe 3 includes the passage in the middle of the inside of the probe 3. In such a case, the solvent flows in the passage in the middle of the inside of the probe 3, the solvent flows out to the surface of the probe 3 through a hole existing at an end of the passage, and, from there, the solvent goes along the probe 3 and reaches the end portion of the probe 3.

While the ionization device according to the present embodiment has a configuration in which the probe 3 includes a passage in its inside, the ionization device according to the present invention may have a configuration including a plurality of passages provided for allowing different solvents to flow in the respective passages. In such a case, different voltages may be applied to the different solvents.

The ionization device according to the present embodiment has a configuration in which the electrode 10 and the voltage applying unit 11 used to apply a voltage to the electrode 10 are connected with each other. In such a configuration, it is favorable that the electrode 10 is formed of a conductive member and is connected with the voltage applying unit 11.

Meanwhile, the ionization device according to the present invention is configured from an insulator in which a conductive member is arranged on the electrode surface 20 close to the probe 3 of the electrode 10, and may have a configuration in which the voltage applying unit 11 is connected to the conductive member, and applies a voltage to the Taylor cone 8.

While the ionization device according to the present embodiment uses laser light in order to improve the ionization efficiency of the substance dissolved in the solvent, the laser light of the ionization device according to the present invention may be used for ionization after being subjected to a photochemical reaction by irradiating the substance with the laser light. To be specific, a photocatalyst reaction, a light sectioning reaction, or an optical absorption reaction is used.

In the ionization device according to the present embodiment, the solution (Taylor cone) irradiated with the laser light is promptly subjected to electrospray ionization. Therefore, an analysis of a substance having a short lifetime of 1 millisecond or less (such as radical molecule or reaction intermediate) can be performed, for example.

While the electrode 10 included in the ionization device according to the present embodiment is provided with a pump (not illustrated), the pump is stopped and only the drawing effect by the electric field can be used. In such a case, the mass spectrometer according to the present embodiment can draw the ions into the mass spectrometer only with the drawing effect by the electric field.

The ionization device according to the present embodiment may be used for a time-of-flight mass spectrometer, or may be used as an ion generation unit of a quadrupole mass spectrometer, a magnetic sector mass spectrometer, an ion trap mass spectrometer, and an ion cyclotron mass spectrometer.

While application of a voltage to the probe 3 and the electrode 10 included in the ionization device according to the present embodiment is steadily performed, generation of electrospray can be intermittently performed by intermittently performing the application of a voltage. Accordingly, a time of application of a voltage to the substance subjected to degeneration by application of a voltage can be minimized, and the substance can be ionized.

The ionization device according to the present embodiment forms the liquid bridge 6 in an atmospheric pressure environment to ionize the substance. Here, the atmospheric pressure is in a range of 0.1 to 10 times the standard atmospheric pressure of 101325 Pa. The environment of the ionization device according to the present invention may be under an atmosphere that is the same as that of a normal room, or may be under a nitrogen atmosphere or under an inert gas atmosphere such as under an argon atmosphere.

While the ionization device according to the present embodiment has a configuration of causing the solvent to continuously flow into the passage inside the probe 3 at a uniform flow rate, the flow rate (flow speed) of the solvent may be controlled. That is, increase and decrease of the flow rate can be set by an arbitrary value. Accordingly, the flow rate is increased when there is a large amount of substances to be dissolved (substance contained in the sample), while the flow rate is decreased when there is a small amount, so that the fluctuation of the concentration of the substance to be dissolved in the liquid bridge 6 can be suppressed, and the substance contained in the sample can be efficiently ionized. Further, the increase and decrease of the flow rate enables increase and decrease of the size of the liquid bridge. Since the size of the liquid bridge 6 corresponds to the size of a region (portion) to be ionized, the size of the liquid bridge 6 correlates with the spatial resolution of the mass image. If the size of the liquid bridge is small, while the spatial resolution is improved, the number of measuring regions is increased, and thus, the total measurement time is increased. That is, by increasing and decreasing the flow rate, the total measurement time can be changed. For example, first, the mass image is obtained with low spatial resolution, a specific portion is then determined, and the mass image can be precisely obtained with high spatial resolution.

While the ionization device according to the present embodiment has a configuration of continuing the timing of irradiating the Taylor cone 8 with laser light, the ionization device according to the present invention may intermittently irradiate the Taylor cone 8 at arbitrary timings. That is, after irradiation to the Taylor cone with the laser light is performed within a given time, the irradiation may be stopped for a given length of time. For example, in a sample in which a substance that can be easily decomposed by laser light and a substance that is less-easily decomposed coexists, irradiation of the laser light is stopped during a time in which the easily decomposed substance is ionized, and irradiation of the laser light is performed during a time in which the less-easily decomposed substance is ionized, whereby the ionization efficiency can be improved.

Figure 2:
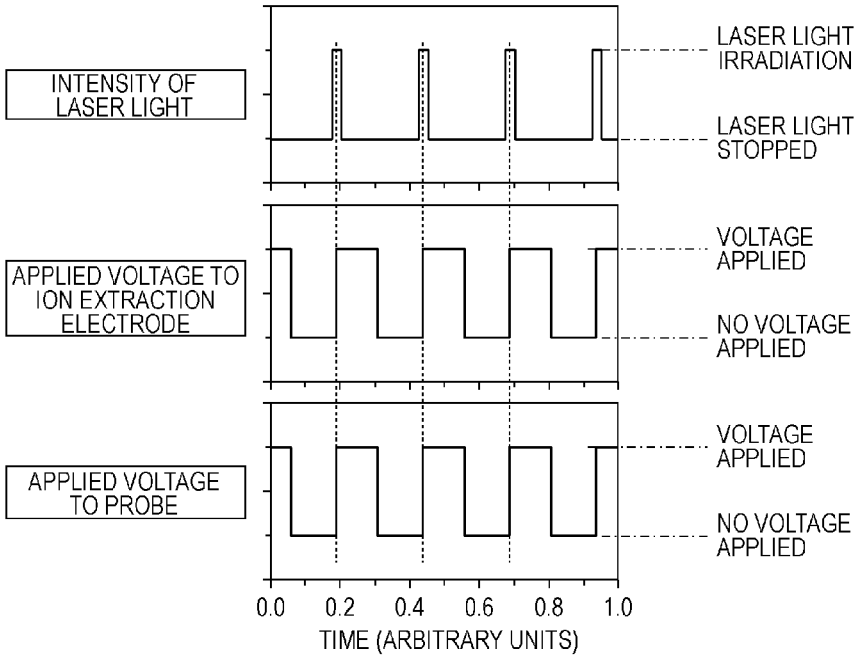
FIG. 2 is a schematic diagram illustrating operation timings of components of the ionization device according to the first of embodiment.

While the ionization device according to the present embodiment steadily performs application of a voltage to the electrode 10 and the probe 3, the timing of the irradiation of the laser light and the timing of the application of a voltage to the electrode 10 and the probe may be adjusted to arbitrary values. For example, immediately after the start of the irradiation of the laser light, the application of a voltage is performed for a certain period of time. Accordingly, unnecessary ions generated during the period in which the laser light is not irradiated are not detected, and the ions generated right after the irradiation of the laser light can be efficiently collected (FIG. 2).

While it has been shown that the setting of the application of a voltage to the electrode 10 and the probe is two conditions: a voltage applied and no voltage applied, it can be set to voltages capable of performing two states: an electrospray is generated, and not generated. That is, the setting of the application of a voltage to the electrode 10 and the probe 3 can be set to two conditions: a voltage in which the electrospray is generated and a voltage in which the electrospray is not generated, and the voltages can be applied.

Figure 5:
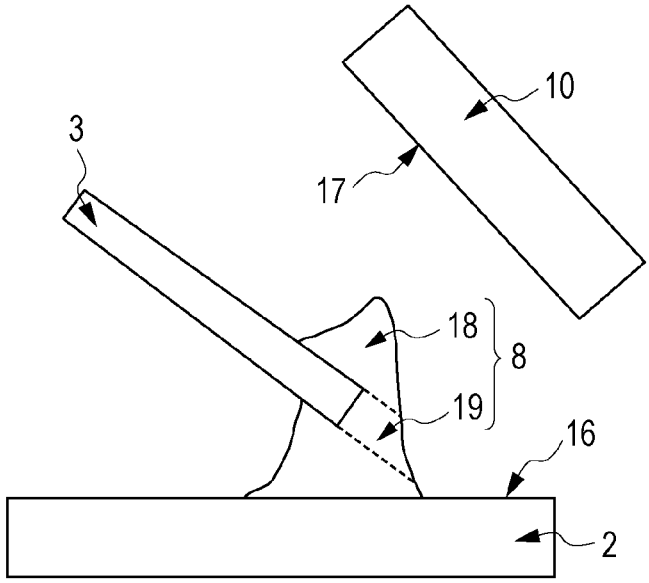
FIG. 5 is a schematic diagram illustrating a Taylor cone according to the present invention.

The Taylor cone 8 generated by the ionization device according to the present embodiment exists at an end portion surface of the probe 3 as illustrated in FIG. 1, and has a cone shape extending toward the electrode surface 20. However, as illustrated in FIG. 5, when the boundary between the liquid bridge 6 and the Taylor cone 8 is not clear, the Taylor cone 8 includes a solution 18 existing between the probe 3 and the electrode surface 20, and having a cone shape extending toward the electrode surface 20, and a solution 19 of a region that exists on the assumption that the probe 3 is extended. Note that, in such a case, it can be said that the Taylor cone 8 exists at the end portion surface of the probe 3, and has a cone shape extending toward the electrode surface 20. Further, in this case, the laser light irradiates one of or both of the solution 18 existing between the probe 3 and the electrode surface 20 and having a cone shape extending toward the electrode surface 20, and the solution 19 of a region that exists on the assumption that the probe 3 is extended.

While the vibration imparting unit 16 included in the ionization device according to the present embodiment is held by the holding portion 1, the vibration imparting unit included in the ionization device according to the present invention may exist outside the holding portion and may be connected with a holding portion. Further, while the vibration imparting unit included in the ionization device according to the present embodiment vibrates the holding portion 1 in the vertically up and down direction, the direction of vibration of the holding portion by the vibration imparting unit included in the ionization device according to the present invention is not restricted to the vertically up and down direction. For example, the holding portion may be repeatedly vibrated between a direction indicated by a vector that is made by a combination of a vector in the vertically upward direction and a vector in the ±30° direction from the vertically upward direction, and a direction opposite to the upward direction.

Second Embodiment

An ionization device, a mass spectrometer, and an image display system according to a second embodiment of the present invention has a form in which an end portion of a probe 3 included in the ionization device vibrates. The second embodiment is the same as the first embodiment other than the above.

Figure 3:
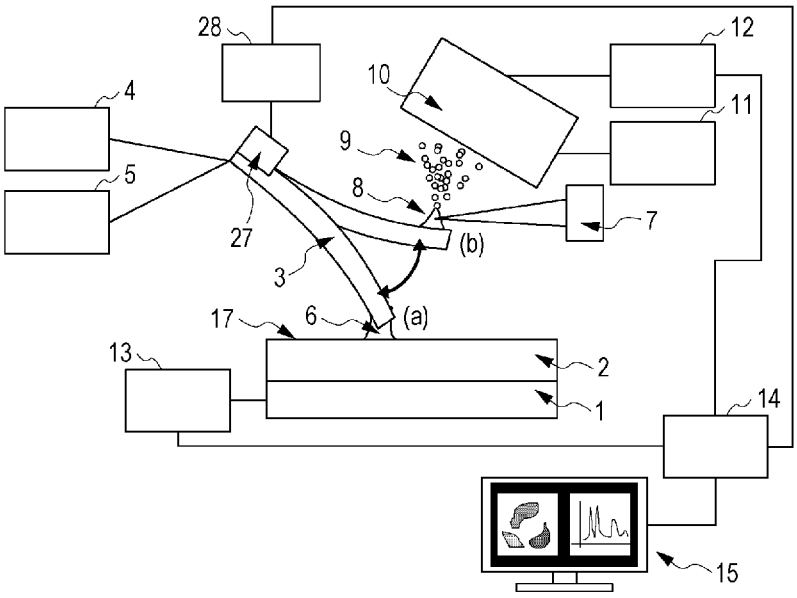
FIG. 3 is a schematic diagram illustrating an image display system including an ionization device according to a second embodiment.

FIG. 3 is a schematic diagram of the ionization device according to the second embodiment. Note that reference signs in FIG. 3 that are the same as those in FIG. 1 indicate the same elements and functions.

In the ionization device according to the present embodiment, a vibration imparting unit 27 is provided in the probe 3 instead of in a holding portion 1. The vibration imparting unit 27 is connected with a voltage applying unit 28 and is connected with an analysis position specifying unit 14. The probe 3 vibrates between a sample 2 and an electrode 10 as indicated by a thick double arrow in FIG. 3 by the vibration imparting unit 27. To be specific, the probe 3 vibrates in a reciprocating manner such that the probe 3 and the sample 2 repeatedly approach and separate from each other.

The vibration imparting unit 27 may be implemented by a piezoelectric device, a motor element, an ultrasonic motor, or the like. Other configurations may also by possible, as long as the vibration imparting unit 27 allows the probe 3 to vibrate in the manner described above. The degree of the vibration of the probe 3 is in a range of 10 nanometers to 10 millimeters, and the frequency of vibration may range from 10 Hz to 10 MHz.

As the probe 3 continuously vibrates, a liquid bridge 6 is formed between the probe 3 and the sample 2 in a state where the probe 3 is in a position in contact with or adjacent to the sample 2. In the state where the probe is in a position separating from the sample 2 (in a position closer to the electrode 10 than to a position where the liquid bridge 6 is formed) in the middle of the vibration of the probe 3, the liquid bridge 6 is not formed, and a Taylor cone 8 is caused to form and droplets 9 are sprayed. That is, the probe 3 and the sample 2 approach and separate from each other, so that the formation of the liquid bridge and the generation of the droplets 9 can be separately performed. Note that, in the present specification and the present invention, the "the position closer to the electrode than to the position where the liquid bridge 6 is formed, and the position where no liquid bridge is formed" may be expressed as "a position different from the position where the liquid bridge is formed".

In a state where the probe 3 separates from the sample 2 and forms the Taylor cone 8 in the middle of the vibration of the probe 3 (the state shown in FIG. 3), the Taylor cone 8 is irradiated with laser light emitted from the light source 7, while in a state where the probe 3 is in contact with or adjacent to the sample 2 and the liquid bridge 6 is formed in the middle of the vibration of the probe 3, the laser light does not irradiate the Taylor cone.

In the ionization device of the present embodiment, a contact time of the probe 3 and the sample 2 is decreased by the vibration of the probe 3. Therefore, breakdown of the sample 2 by the probe 3 associated with relative displacement between the probe 3 and the sample 2 (relative movement of the sample 2 by scanning in the in-plane direction on the surface 17) can be prevented. In addition, by shortening the formation time of the liquid bridge 6, the size of the liquid bridge 6 can be reduced, and the spatial size of the portion from which the ions are generated can be decreased. As a result, the spatial resolution of the ionization device is improved.

In the ionization device according to the present embodiment, the vibration imparting unit 27 vibrates the probe 3. However, the ionization device according to the present invention may use spontaneous resonance of the probe without providing the vibration imparting unit. For example, the size of the probe, the material, the size of the passage, the magnitude of the voltage applied to the electrode 10, and the flow rate of the solvent can be selected as follows:

The size of the probe: the length of 10 micrometers to 100 millimeters

The material: glass, stainless steel, silicone, or PMMA

The size of the passage: the cross-section area of the passage 1 square micrometer to 1 square millimeter The magnitude of the applied voltage: 0 V to ±10 kV The flow rate of the solvent: 1 nanoliter/minute to 1000 microliter/minute Further, both of the probe and the holding portion may vibrate. In such a case, the vibration imparting unit connected with the holding portion or existing in the holding portion exists separately from the vibration imparting unit that vibrates the probe, and may vibrate the holding portion. It is favorable that the vibration imparting unit connected with the holding portion or existing in the holding portion vibrates the holding portion such that the probe 3 and the sample 2 repeatedly approach and separate from each other. More favorably, the holding portion is vibrated in the vertically up and down direction.

While the vibration imparting unit 27 continuously vibrates in the ionization device according to the present embodiment, the vibration imparting unit 27 may intermittently vibrate as long as the mass spectrometry of the ionized substance can be performed in the ionization device according to the present invention. "Intermittently" indicates a case in which a vibrating state and a stopped state are repeated, or a state in which the degree of vibration and/or the period of the probe in vibration are repeatedly changed.

Further, the vibration frequency set to the vibration imparting unit 27 may be either a resonance frequency or a non-resonance frequency.

While the end portion of the probe 3 vibrates between the sample 2 and the electrode 10 in the ionization device according to the present embodiment, the probe may be subjected to a revolving movement in the ionization device according to the present invention. In the case of revolving the probe, vibrations in directions of mutually perpendicular two axes may just be provided to the probe. The vibrations in such a case are a combined wave of two sine waves. The probe may be subjected to the revolving movement such that the probe end portion draws a locus of not only a single circumference curve but also a spiral curve, a Lissajous curve, and the like.

While, in the ionization device according to the present embodiment, the liquid supply unit 4 continuously supplies the solvent to the probe 3, and continuously supplies the solvent between the probe 3 and the sample 2, in the ionization device according to the present invention, the liquid supply unit may supply the solvent between the probe and the sample when the probe and the sample approach each other (e.g., when they come in contact with each other or are in close proximity to each other), and may stop supply of the solvent when the probe and the sample are separated by at least a certain distance. That is, the supply of the solvent may be synchronized with the vibration of the probe.

Various methods for detecting the vibration of the probe 3 in the ionization device may be advantageously used according to the present embodiment. Examples of the methods include irradiating laser light on a side surface of the probe 3 (the laser light being different from the laser light that irradiates the Taylor cone 8) and detecting displacement of reflected light; connecting an electrical element for vibration detection (vibration sensor) to the probe 3 and detecting distortion of the probe 3 from a change in electric resistance of the element; connecting a magnetic body to the probe 3 and detecting a change in induction current flowing through a coil adjacent to the probe 3.

While, in the ionization device according to the present embodiment, the laser light irradiates the Taylor cone 8 in forming the liquid bridge 6, in the ionization device according to the present invention, the laser light may be intermittently irradiated at arbitrary timings. That is, after the irradiation of the laser light to the Taylor cone is performed for a given length of time, the irradiation is stopped for a given length of time. For example, in a sample in which a substance that can be easily decomposed by laser light and a substance that is less-easily decomposed coexists, irradiation of the laser light is stopped during a time in which the easily decomposed substance is ionized, and irradiation of the laser light is performed during a time in which the less-easily decomposed substance is ionized, whereby the ionization efficiency can be improved. In such a case, the number of the irradiation of the laser light may be smaller than the number of the formation of the Taylor cone 8. For example, the number of the irradiation of the laser light after the formation of the Taylor cone within a certain period of time can be set to an arbitrary value, which, for example, includes a case where the laser light is irradiated five times at arbitrary timings during a period in which the Taylor cone 8 is formed ten times. The number of only the formation of the Taylor cone without irradiation of the laser light can be also set to an arbitrary value.

To synchronize timings of the formation of the Taylor cone 8 and the irradiation of the laser light in the ionization device according to the present embodiment, the synchronization can be performed by adjusting the frequency and the phase of the probe 3 and the frequency and the phase of a control signal of the laser light. It is desirable to synchronize a signal that has monitored the vibration of the probe 3 and a signal that controls the irradiation timing of the laser light using a synchronization circuit.

While the ionization device according to the present embodiment steadily performs the application of a voltage to the electrode 10, the ionization device according to the present invention may synchronize timings of the vibration of the probe 3 and the application of a voltage to the electrode 10. Accordingly, unnecessary ions generated during the period in which the liquid bridge 6 is being formed are not detected, and noise of obtained measured data can be reduced. In addition, it can be performed by synchronizing the timing of the vibration of the probe and the timing of the irradiation of the laser light. (FIG. 4)

Figure 4:
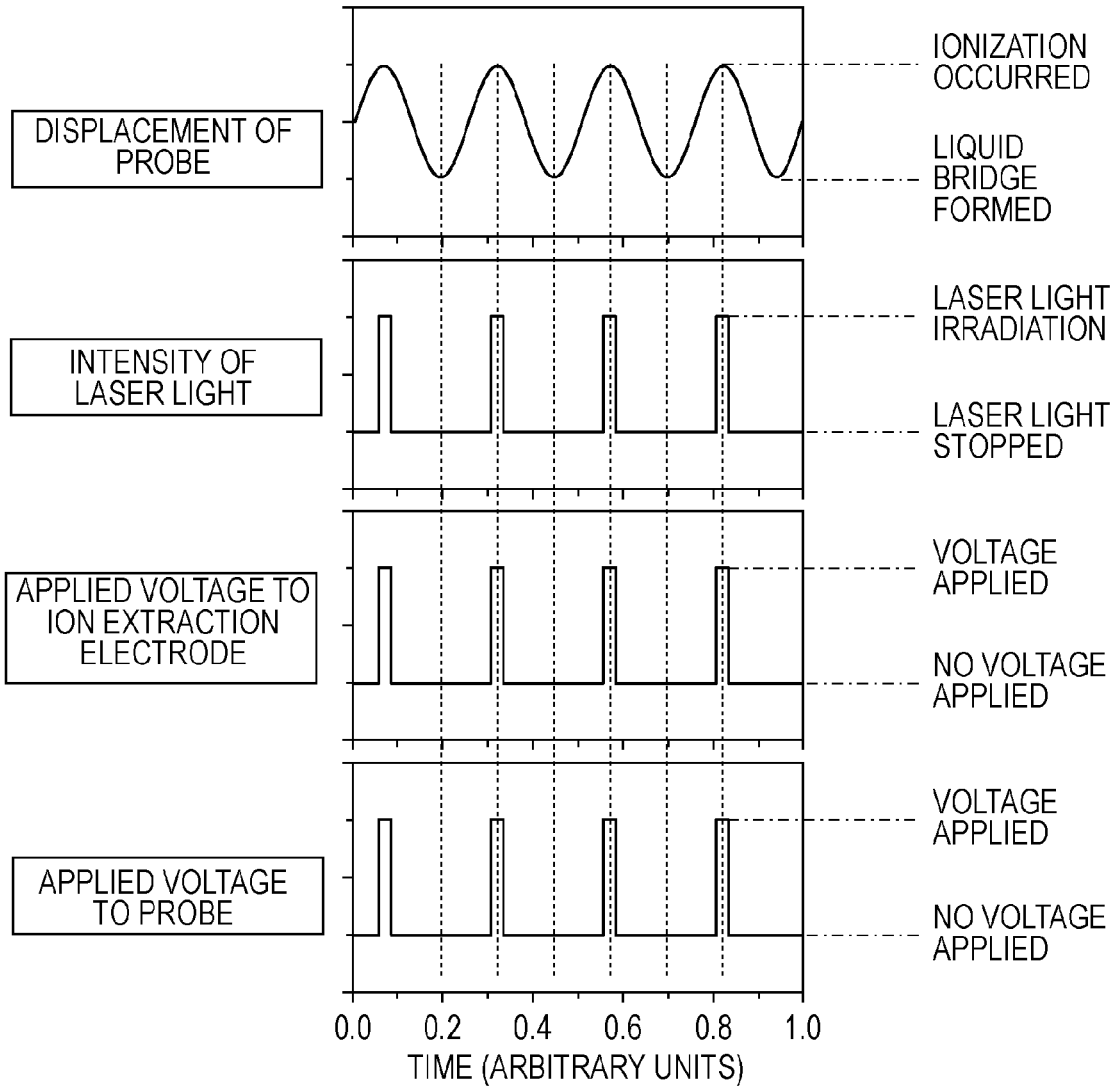
FIG. 4 is a schematic diagram illustrating operation timings of components of the ionization device according to the second embodiment.

While, in FIG. 4, it has been shown that the setting of the application of a voltage to the electrode 10 and the probe 3 is two conditions: a voltage applied and no voltage applied, it can be set to voltages capable of performing two states: an electrospray is generated, and not generated. That is, the setting of the application of a voltage to the electrode 10 and the probe 3 can be set to two conditions: a voltage in which the electrospray is generated and a voltage in which the electrospray is not generated, and the voltages can be applied.

To synchronize timings of the formation of the liquid bridge 6, the irradiation of the laser light, and the application of a voltage to the electrode 10, the synchronization can be performed by adjusting the vibration of the probe 3, the control signal of the laser light, and the frequency and the phase of the control signal of the application of a voltage to the electrode 10. In this case, it is desirable to synchronize the signals in the synchronization circuit.

When the timings of the formation of the liquid bridge 6, the irradiation of the laser light, and the application of a voltage to the electrode 10 are synchronized, to be more accurate, it is necessary to accurately adjust the timings of the vibration of the probe, the irradiation of the laser light, the application of a voltage to the extraction electrode, the applied voltage to the probe, the displacement of the holding portion that holds the sample, and the acquisition and storage of data. An example of a synchronization circuit capable of performing such adjustment and a device controlled by an output signal of the synchronization circuit is illustrated in FIG. 6.

Figure 6:
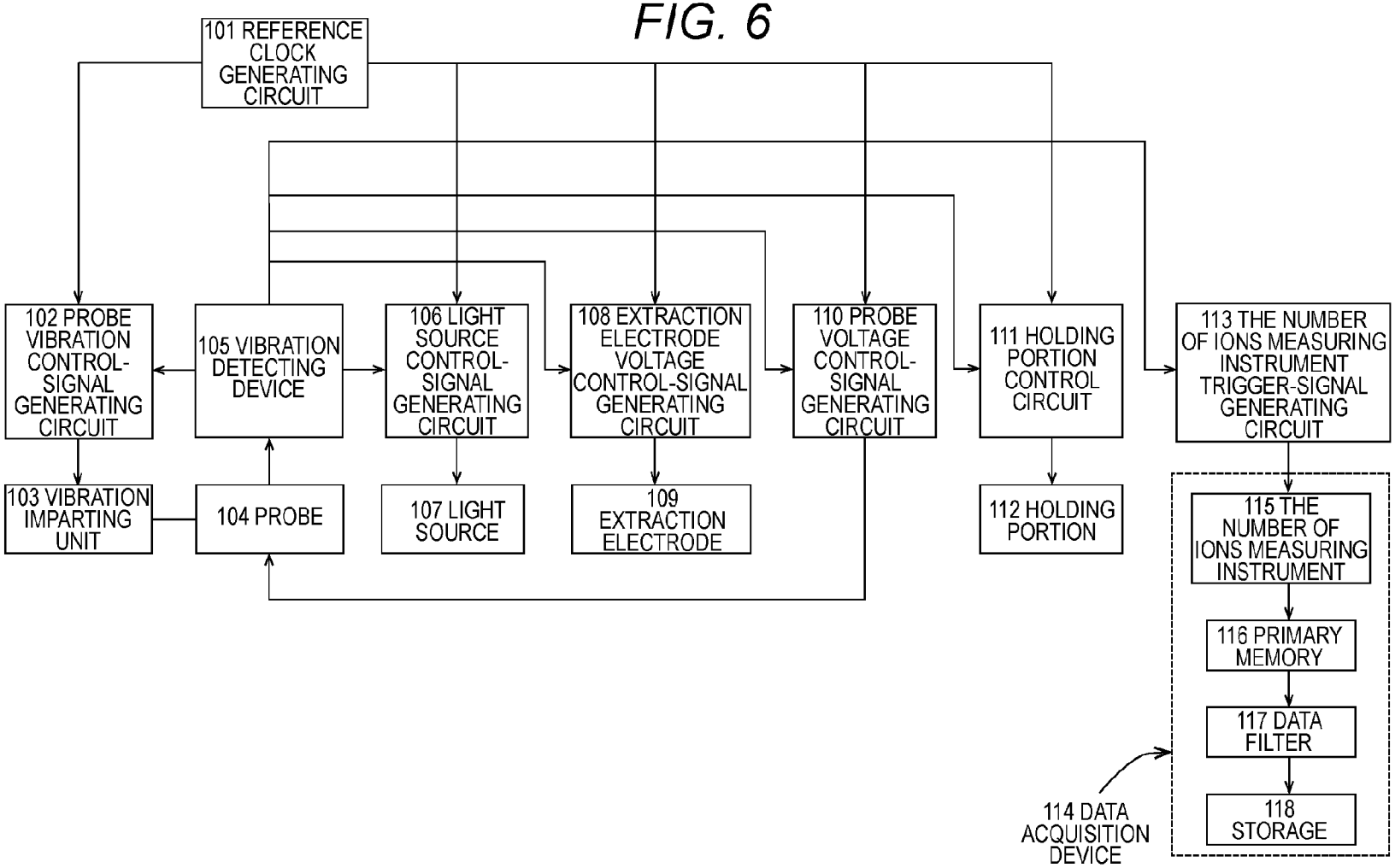
FIG. 6 is a schematic diagram illustrating a device controlled by a synchronization circuit and an output signal of the synchronization circuit of the ionization device according to the second embodiment.

FIG. 6 illustrates a reference clock generation circuit 101, a probe vibration control-signal generating circuit 102, a light source control-signal generating circuit 106, an extraction electrode voltage control-signal generating circuit 108, a probe voltage control-signal generating circuit 110, a holding portion control circuit 111 that holds a sample, the number of ions measuring instrument trigger-signal generating circuit 113, a vibration imparting unit 103, a probe 104, a vibration detecting device 105, a light source 107, an extraction electrode 109, a holding portion 112 that holds a sample, a data acquisition device 114, the number of ions measuring instrument 115, a primary memory 116, a data filter 117, and a storage 118.

In the above description, an example of using a field programmable gate array (FPGA) and an application specific integrated circuit (ASIC) has been illustrated, where the synchronization circuit described here is implemented. By using these circuits, a plurality of control circuits (101, 102, 106, 108, 110, and 111) are implemented on an integrated circuit, control timings thereof can be accurately adjusted at a high speed.

Voltage signals that control devices connected at subsequent stages are generated in the probe vibration control-signal generating circuit 102, the light source control-signal generating circuit 106, the extraction electrode voltage control-signal generating circuit 108, the probe voltage control-signal generating circuit 110, the holding portion control circuit 111, and the number of ions measuring instrument trigger-signal generating circuit 113. The voltage signals are respectively output to the vibration imparting unit 103, the light source 107, the extraction electrode 109, the probe 104, the holding portion 112, and the number of ions measuring instrument 115. These voltage signals are any of a triangle wave, a rectangular wave, a sine wave, and a cosine wave.

In the probe vibration control-signal generating circuit 102, to make a phase difference 0 (zero) between a voltage signal obtained by detecting actual vibration of the probe 104 and a voltage signal generated based on a reference clock generated from the reference clock generating circuit 101, a feedback circuit is embedded, and the probe 104 is vibrated at a given frequency by driving of the circuit.

For the detection of the actual vibration of the probe 104, the vibration detecting device 105 is used, and an output signal from the vibration detecting device 105 is input to the probe vibration control-signal generating circuit 102. Such a drive mechanism is typically known as a phase locked loop (PLL). By providing a delay compensation circuit inside the circuit for PLL, a voltage signal having an arbitrary delay time to the reference signal can be generated.

The output signal from the vibration detecting device 105 is also input to the light source control-signal generating circuit 106, the extraction electrode voltage control-signal generating circuit 108, the probe voltage control-signal generating circuit 110, the holding portion control circuit 111, and the number of ions measuring instrument trigger-signal generating circuit 113. Specific times such as a timing of forming the liquid bridge by the probe, a timing of occurrence of ionization at the probe tip portion, and a timing between the liquid bridge and the ionization are extracted from among the input voltage signal, and driving of devices connected to the circuits are controlled within the periods.

For example, when a signal of the displacement of the probe of FIG. 4 is the output signal of the vibration detecting device 105, and the signal is input to the light source control-signal generating circuit 106, the extraction electrode voltage control-signal generating circuit 108, the probe voltage control-signal generating circuit 110, and the holding portion control circuit 111, a specific threshold of voltage is set, and a period in which the voltage is smaller than the threshold can be set to the timing of forming the liquid bridge, or a period in which the voltage is larger than the threshold can be the timing of the occurrence of ionization. The timing of the application of a voltage to the probe 104, the timing of the irradiation of the light of the light source 107, the timing of the application of a voltage to the extraction electrode 109, and the timing of displacement of the holding portion 112 are controlled to synchronize with the timings determined in the above manner. In addition, by using the signal from the reference clock generating circuit 101, the timing of the application of a voltage to the probe 104, the timing of the irradiation of the light of the light source 107, the timing of the application of a voltage to the extraction electrode 109, and the timing of displacement of the holding portion 112 can be quantitatively measured and controlled.

The output signal generated in the number of ions measuring instrument trigger-signal generating circuit 113 is input as a gate voltage signal of the number of ions measuring instrument 115. The number of ions measuring instrument 115 usually receives a trigger signal of the mass spectrometer intermittently, and operates to measure the number of ions that have reached a detector of the mass spectrometry after the reception of the trigger signal.

The trigger signal differs depending on the configuration of the ion separation unit of the mass spectrometer, and when a quadrupole mass spectrometer, a time-of-flight mass spectrometer, a magnetic sector mass spectrometer, an ion trap mass spectrometer, or the like is used as the mass spectrometer, a specific timing can be used as the trigger signal in each mass spectrometry.

For example, a signal that indicates a timing of start of application of a high frequency voltage to a quadrupole electrode in the quadrupole mass spectrometer; a signal that indicates a timing of application of a pulse voltage for accelerating ions in the device that measures the flight time of the ions in the time-of-flight mass spectrometer; a signal that indicates a timing of start of application of a magnetic field to a sector electrode in the magnetic sector mass spectrometer; and a signal that indicates a timing of introduction of ions to an ion trap in the ion trap mass spectrometer can be respectively used as the trigger signal. Typically, the pulse voltage in the time-of-flight mass spectrometer and the frequency of drawing in the ions in the ion trap mass spectrometer is often higher than the vibration frequency of the probe.

Further, a gate voltage signal is output to synchronize with the timing of occurrence of ionization at the probe tip portion. In this case, the number of ions measuring instrument 115 is set to operate in response to a period in which the gate signal is being output. Here, the gate signal is any of a positive voltage/negative voltage/0 volt, and differs depending on the number of ions measuring instrument. Since the number of ions measuring instrument can be operated only during the time in which the ions are generated from the probe, noise signals during the formation of the liquid bridge and a period from the formation of the liquid bridge to the occurrence of ionization are not measured, whereby the noise signals included in the signals of the measured data can be reduced.

Next, a method of recording the voltage signal from the number of ions measuring instrument 115 as digital data. A signal from the number of ions measuring instrument 115 is stored in the primary memory 116 for a given length of time through analog/digital conversion. Measured data corresponding to the type of ion to be measured is selected, and is stored in the storage 118 such as an HDD and an SSD. The process of selecting the data is programmatically processed in the data filter 117, and new data is then written over data in the memory. By storing the data in the storage after selecting the data, the total amount of data can be reduced, and this can be applied to the case where the ion to be measured is determined in advance. Meanwhile, when detection of an unknown ion is performed, all data obtained with the number of ions measuring instrument 115 can also be stored in the storage 118.

In measuring a wide range of an object to be measured, it is necessary to displace the holding portion 112. The holding portion control circuit 111 generates a signal for controlling the position of the holding portion 112 based on the reference clock, and outputs the signal to the holding portion 112. At this time, a timing of occurrence of ionization at a probe tip portion and the number of ionization within a specific length of time are measured based on the signal from the vibration detecting device 105, so that the number of the ionization in each sample position can be quantitatively adjusted. While displacing the holding portion 112, the above data acquisition process and the storage process can be continuously performed. This enables storing of two dimensional data of the object to be measured in a continuous manner.

While the embodiments have been described, in which the signal generation circuits respectively generate output signals with respect to the thresholds, the present invention is not limited to the embodiments, a common signal generation circuit can be separately provided, a specific time to the signal of 105 can be extracted, and a voltage signal corresponding to the time can be input to the signal generation circuits 106, 108, 110, 111, and 113.

All or a part of the signal generation circuits 106, 108, 110, 111, and 113 may be driven. In a case where a part of the signal generation circuits is driven, only necessary circuits from among the signal generation circuits 106, 108, 110, 111, and 113 may be implemented in the synchronization circuit.

Further, the above-described synchronization method shows a synchronization method in a case where the probe in the second embodiment vibrates. However, in a case where the probe is stopped like the first embodiment, the probe vibration control-signal generating circuit 102, the vibration imparting unit 103, and the vibration detecting device 105 related to the vibration of the probe are stopped, and the signal from the reference clock generating circuit 101 can be used for the control circuits to generate various control signals.

According to the present invention, an ionization device, a mass spectrometer including the ionization device, and an image display system including the mass spectrometer that are excellent in ionization even in an atmospheric pressure environment can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-197205, filed Sep. 7, 2012, which is hereby incorporated by reference herein in its entirety.

What is claimed is:

1. An ionization device comprising:

a holding portion configured to hold a sample;

a probe configured to arrange a liquid on a surface of the sample to form a liquid bridge between the probe and the sample;

an electrode configured to form, at the probe, a Taylor cone of a substance contained in the sample, and to release the ionized substance from the Taylor cone;

a voltage applying unit configured to apply a voltage to the electrode; and a light source configured to emit laser light, wherein the light source is arranged such that the laser light irradiates the Taylor cone.

2. The ionization device according to claim 1, wherein the electrode also serves as an electrode configured to form the Taylor cone at a position different from a position where the liquid bridge is formed.

3. The ionization device according to claim 1, wherein the light source is arranged not to irradiate the liquid bridge with the laser light.

4. The ionization device according to claim 1, comprising a vibration imparting unit configured to vibrate at least one of the probe and the holding portion such that the probe and the sample repeatedly approach each other and separate from each other.

5. The ionization device according to claim 4, wherein the vibration imparting unit vibrates the probe.

6. The ionization device according to claim 1, wherein the laser light performs pulsed oscillation.

7. The ionization device according to claim 1, comprising a displacing unit configured to displace the holding portion.

8. The ionization device according to claim 4, comprising a synchronization circuit for synchronizing a timing of the irradiation of the laser light with at least one of a timing of the vibration of the sample, a timing of the vibration of the probe, and a timing of the application of a voltage to the electrode.

9. A mass spectrometer comprising the ionization device according to claim 1 as an ionization unit, further comprising:

a mass spectrometry unit configured to analyze mass of the ionized substance; and an analysis position specifying unit configured to specify an analysis position in the sample.

10. A mass spectrometer comprising:

an ionization unit including the ionization device according to claim 4;

a mass spectrometry unit configured to analyze mass of the ionized substance; and an analysis position specifying unit configured to specify an analysis position in the sample, the spectrometer including, a synchronization circuit for synchronizing a timing of the irradiation of the laser light with an operation timing of a number of ions measuring instrument included in the mass spectrometry unit.

11. An image display system comprising:

the mass spectrometer according to claim 9; and an image display unit connected to the mass spectrometer, wherein the analysis position specifying unit forms image information for displaying an image of a distribution of the substance contained in the sample from information of the analysis position of the sample, and information of the mass obtained from the mass spectrometer.

12. An analysis method comprising:

applying a voltage to a liquid;

arranging the liquid on a surface of a sample to form a liquid bridge between a probe and the sample;

applying a voltage to an electrode to form, at the probe, a Taylor cone including a substance contained in the sample;

irradiating the Taylor cone with laser light; and analyzing mass of the substance released from the Taylor cone and ionized.

13. The analysis method according to claim 12, further comprising vibrating at least one of the sample and the probe, wherein the Taylor cone is irradiated with laser light in a state where at least one of the sample and the probe is being vibrated.

14. The analysis method according to claim 12, further comprising vibrating the probe such that the probe moves between the sample and the electrode in a reciprocating manner at a predetermined frequency, wherein the Taylor cone is irradiated with laser light in a state where the probe is being vibrated at the predetermined frequency.

15. An ionization device comprising:

a holding portion configured to hold a sample;

a probe configured to arrange a liquid on a surface of the sample to form a liquid bridge between the probe and the sample;

an electrode arranged to face the sample;

a voltage applying unit configured to apply a voltage to the electrode; and a light source configured to emit laser light which irradiates the Taylor cone, wherein, in response to the voltage applying unit applying voltage to the electrode, the electrode forms at the probe a Taylor cone of the liquid contained on the surface of the sample and release an ionized substance from the Taylor cone towards the electrode.

* * * * *